US005863714A

United States Patent [19]

Kato et al.

[11] Patent Number: 5,863,714

[45] Date of Patent: Jan. 26, 1999

[54] SILVER HALIDE LIGHT-SENSITIVE MATERIAL

[75] Inventors: Takashi Kato; Takayoshi Oyamada, both of Minami-ashigara, Japan

[73] Assignee: Fuji Photo Film Co., Ltd., Kanagawa-ken, Japan

[21] Appl. No.: 839,750

[22] Filed: Apr. 15, 1997

[30] Foreign Application Priority Data

Apr. 17, 1996 [JP] Japan ..... 8-095475

[51] Int. Cl.[6] ..... G03C 1/08; G03C 1/83

[52] U.S. Cl. ..... 430/592; 430/517; 430/573; 430/578; 430/579

[58] Field of Search ..... 430/578, 579, 430/592, 573, 517, 584

[56] References Cited

U.S. PATENT DOCUMENTS 4,594,312 6/1986 Sabongi et al. ..... 430/339

*Primary Examiner*—Thorl Chea

*Attorney, Agent, or Firm*—Sughrue, Mion, Zinn, Macpeak & Seas, PLLC

[57] ABSTRACT

There is disclosed a silver halide light-sensitive material which contains a methine compound represented by general formula (1):

General formula (1)

wherein A1, A2, and A3 each represent a streptocyanine dye; L1, L2, L3, and L4 each represent a divalent linking group, and n1 represents an integer of not less than 0. The light-sensitive material exhibits high absorptivity.

10 Claims, No Drawings

SILVER HALIDE LIGHT-SENSITIVE MATERIAL

FIELD OF THE INVENTION

The present invention relates to a silver halide light-sensitive material containing a novel streptocyanine dye. More specifically, the present invention relates to a silver halide light-sensitive material containing a linking-type streptocyanine dye that comprises streptocyanine dyes connected with each other through two divalent linking groups at two positions of each of the dyes.

BACKGROUND OF THE INVENTION

Streptocyanine dye is an important photographic sensitizing dye. However, in the present state of the art, absorbability of the dye to a silver halide emulsion (grains) is weak. Consequently, the absorptivity of the dye in the silver halide emulsion is low and insufficient.

SUMMARY OF THE INVENTION

Accordingly, an object of the present invention is to provide a silver halide light-sensitive material that exhibits high absorptivity (light-absorption factor).

Other and further objects, features, and advantages of the invention will appear more fully from the following description.

DETAILED DESCRIPTION OF THE INVENTION

The above-described object of the present invention has been attained by a silver halide light-sensitive material containing a streptocyanine dye represented by the following general formula (1):

General formula (1)

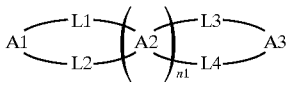

wherein A1, A2, and A3 each represent a streptocyanine dye; L1, L2, L3, and L4 each represent a divalent linking group, and n1 represents an integer of not less than 0.

In particular, a silver halide light-sensitive material containing a streptocyanine dye represented by general formula (2) as shown below, is effective. General formula (2)

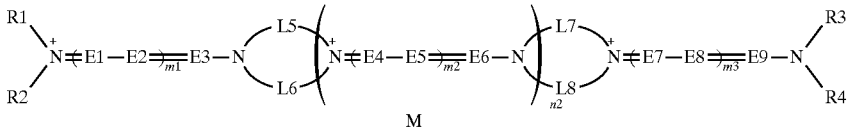

wherein R1, R2, R3, and R4 each represent an alkyl group or an aryl group; E1, E2, E3, E4, E5, E6, E7, E8, and E9 each represent a methine group; L5, L6, L7, and L8 each represent a divalent linking group; m1, m2, m3, and n2 each represent an integer of not less than 0, and M represents an ion for charge neutralization.

Streptocyanine dyes represented by general formula (1) or (2) are explained below in detail.

A1, A2, and A3 each represent a streptocyanine dye. The streptocyanine dye is a general term of compounds having a conjugated system represented by general formula (3) as shown below.

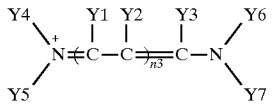

General formula (3)

wherein Y1, Y2, and Y3 each represent a hydrogen atom, an alkyl group having 1 to 20 carbon atoms [e.g. methyl, ethyl, n-propyl, n-butyl, n-pentyl, n-hexyl, n-heptyl, n-nonyl, i-propyl, i-butyl, i-pentyl, and t-butyl; and the alkyl group further includes those substituted with a substituent, examples of which substituents are a halogen atom (e.g. chlorine, bromine, iodine, fluorine), a nitro group, an alkoxy group (e.g. methoxy, ethoxy), an aryl group (e.g. phenyl), an aryloxy group (e.g. phenoxy), an amido group, a carbamoyl group, a sulfo group, a hydroxyl group, a carboxyl group, an alkylthio group (e.g. methylthio), and a cyano group; hereinafter these groups are referred to as a substituent group X], an aryl group having 6 to 20 carbon atoms (e.g. phenyl, 1-naphthyl, and 2-naphthyl; and the aryl group further includes those substituted with such a substituent as the above-described substituent group X), an alkoxy group having 1 to 20 carbon atoms (e.g. methoxy, ethoxy; and the alkoxy group further includes those substituted with such a substituent as the above-described substituent group X), or an aryloxy group having 6 to 20 carbon atoms (e.g. phenoxy; and the aryloxy group further includes those substituted with such a substituent as the above-described substituent group X); Y4, Y5, Y6, and Y7 each represent a hydrogen atom, an alkyl group having 1 to 20 carbon atoms (e.g. methyl, ethyl, n-propyl, n-butyl, n-pentyl, n-hexyl, n-heptyl, n-nonyl, i-propyl, i-butyl, i-pentyl, and t-butyl; and the alkyl group further includes those substituted with such a substituent as the above-described substituent group X), or an aryl group having 6 to 20 carbon atoms (e.g. phenyl, 1-naphthyl, and 2-naphthyl; and the aryl group further includes those substituted with such a substituent as the above-described substituent group X); and n3 represents an integer of not less than 0.

Specific examples of the streptocyanine dyes include Dye Nos. 61021 to 61074 described by M. Okawara, T. Kitao, T. Hirashima, M. Matuoka, in *Organic Colorants, A Handbook of Data of Selected Dye for Electro-optical Applications*, Elsvir, New York (1988), pp. 306 to 308.

Al and A3 may be connected to each other to form a streptocyanine dye, forming a ring structure.

L1, L2, L3, L4, L5, L6, L7, and L8 each represent a divalent linking group. Examples of the divalent linking group include an alkylene group having 1 to 20 carbon atoms [e.g. ethylene, propylene, butylene, 1-methylethylene, and 2-methylpropylene; and the alkylene group further includes those substituted with such a substituent as the above-described substituent group X; and the alkylene group may contain, in its main chain, a hetero atom (e.g. oxygen, sulfur, nitrogen), an arylene group (e.g. 1,2-phenylene, 1,3-phenylene, 1,4-phenylene, 1,2-naphthylene), a heterocyclic group (e.g. 2,3-pyridylene) and the like], an alkenylene group having 1 to 20 carbon atoms (e.g. 1,2-ethenylene, 1-methyl-1,2-ethenylene, 1,2-dimethyl-1,2-ethenylene, 1,3-(1-propenylene), and 1,4-(2-butenylene); and the alkenylene group further includes those substituted with such a substituent as the above-described substituent group X), and an alkinylene group having 1 to 20 carbon atoms (e.g. ethinylene, and propinylene; and the alkinylene group further includes those substituted with such a substituent as the above-described substituent group X).

A preferable example of each of L1, L2, L3, L4, L5, L6, L7, and L8 is an alkylene group. An ethylene group is particularly preferred.

R1, R2, R3, and R4 each represent an alkyl group having 1 to 20 carbon atoms [e.g. methyl, ethyl, n-propyl, n-butyl, n-pentyl, n-hexyl, n-heptyl, n-nonyl, i-propyl, i-butyl, i-pentyl, and t-butyl; and the alkyl group further includes those substituted with such a substituent as the above-described substituent group X; and R1 and R2, and R3 and R4, may be combined together to form such a ring as 4-, 5-, 6- or 7-membered ring, in which ring a hetero atom (e.g. oxygen, sulfur, and nitrogen), an arylene group (e.g. 1,2-phenylene, 1,3-phenylene, 1,4-phenylene, 1,2-naphthylene), and a heterocyclic ring (e.g. 2,3-pyridylene) may exist], or an aryl group having 6 to 20 carbon atoms (e.g. phenyl, 1-naphthyl, and 2-naphthyl; and the aryl group further includes those substituted with such a substituent as the above-described substituent group X).

Preferably examples of each of R1, R2, R3, and R4 include an unsubstituted alkyl group, a cyclic alkyl group, and an aryl group. A methyl group, an ethyl group, and a piperazine ring are especially preferred.

E1, E2, E3, E4, E5, E6, E7, E8, and E9 each represent a methine group having 1 to 20 carbon atoms, which group may be substituted with such a substituent as the above-described substituent group X. Preferred examples of the substituent include a methyl group, an ethyl group, a phenyl group, a chlorine atom, a bromine atom, and a methoxy group. Preferably, each of El, E2, E3, E4, E5, E6, E7, E8, and E9 is an unsubstituted methine group.

n1 and n2 each represent an integer of not less than 0. Preferably, each of them is not more than 1,000, although there is no particular upper limitation. When the dye is a polymer dye, each of nl and n2 is preferably in the range of from 10 to 100, and especially preferably from10 to 20. When the dye is an oligomer, each of n1 and n2 is preferably in the range of from 0 to 10, and especially preferably 0, 1, 2, or 3.

n3, ml, m2, and m3 each are preferably 0, 1, 2, 3, 4, or 5, and more preferably 1, 2, or 3.

M represents an ion for charge neutralization. Whether a specific compound is cationic or anionic, or whether the compound has a net ionic charge, depends on the compound's substituent. Typical examples of a cation are an ammonium ion and an alkali metal ion. On the other hand, an anion may be an inorganic ion or an organic ion.

Examples of the cation include a sodium ion, a potassium ion, a triethylammonium ion, a pyridinium ion, and a 1-ethylpyridinium ion. Examples of the anion include a halogen anion (e.g. chloride, bromide, fluoride, and iodide ion), a substituted arylsulfonic acid ion (e.g. a peratoluene sulfonic acid ion), an alkylsulfuric acid ion (e.g. a methyl sulfuric acid ion), a sulfuric acid ion, a perchioric acid ion, a tetrafluoroboric acid ion, and an acetic acid ion.

Preferable combinations of streptocyanine dyes and linking groups are explained below.

When the dye is represented by general formula (1), preferable combinations are as follows:

a combination in which Al to A3 each represent a trimethinestreptocyanine dye, and L1 to L4 each represent an alkylene group (n1 represents an integer of not less than 0); a combination in which A1 to A3 each represent a pentamethinestreptocyanine dye, L1 to L4 each represent an alkylene group, and n1 is 0 or 1; a combination in which A1 to A3 each represent a pentamethinestreptocyanine dye, L1 to L4 each represent an alkylene group, and n1 is an integer of not less than 2; and a combination in which A1 to A3 each represent a heptamethinestreptocyanine dye, and L1 to L4 each represent an alkylene group (n1 is an integer of not less than 0).

When the dye is represented by general formula (2), a combination in which R1 to R4 each represent an alkyl group, L5 to L8 each represent an alkylene group, E1 to E9 each represent an unsubstituted methine group, ml to m3 each represent 1, 2, or 3, and n2 is an integer of from 0 to 10 is preferred.

Specific examples of the compound represented by general formulas (1) and (2) for use in the present invention are illustrated below, but the present invention is not limited to those shown.

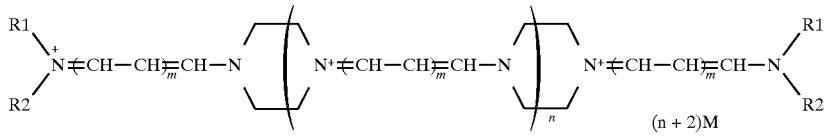

| Compound No. | m | n | R1 | R2 | M |
|---|---|---|---|---|---|
| 1 | 0 | 0 | Me | Me | $ClO_4^-$ |
| 2 | 0 | 1 | Me | Me | $Cl^-$ |
| 3 | 1 | 0 | Me | Me | $ClO_4^-$ |
| 4 | 1 | 1 | Me | Me | $Cl^-$ |
| 5 | 1 | 1 | Me | Me | $BF_4^-$ |
| 6 | 1 | 2 | Me | Me | $Cl^-$ |
| 7 | 2 | 0 | Me | Me | $ClO_4^-$ |

-continued
| | | | | | |
|---|---|---|---|---|---|
| 8 | 2 | 1 | NBoC | | $Cl^-$ |
| 9 | 2 | 2 | NBoC | | $Cl^-$ |
| 10 | 2 | 0 | NH | | $Cl^-$ |
| 11 | 2 | 5 | NBoC | | $Cl^-$ |
| 12 | 2 | 0 | NAc | | $Cl^-$ |
| 13 | 3 | 0 | Me | Me | $ClO_4^-$ |
| 14 | 4 | 0 | Me | Me | $ClO_4^-$ |
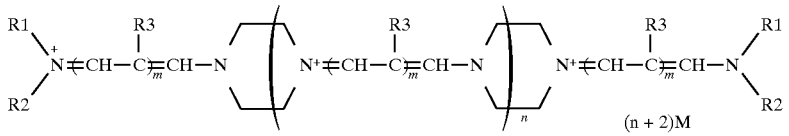
| Compound No. | m | n | R1 | R2 | R3 | M |
|---|---|---|---|---|---|---|
| 15 | 2 | 1 | Me | Me | H | $ClO_4^-$ |
| 16 | 2 | 2 | Me | Me | H | $ClO_4^-$ |
| 17 | 2 | 3 | Me | Me | H | $ClO_4^-$ |
| 18 | 2 | 4 | Me | Me | H | $Cl^-$ |
| 19 | 2 | 10 | Me | Me | H | $Cl^-$ |
| 20 | 2 | 0 | Me | Me | Me | $BF_6^-$ |
| 21 | 1 | 0 | Me | Me | $CH_3$ | $ClSO_3^-$ |
| 22 | I | 0 | Me | Me | $CH_2Ph$ | $ClSO_3^-$ |
| 23 | 2 | 0 | S | | H | $ClO_4^-$ |
| 24 | 2 | 0 | O | | H | $ClO_4^-$ |
| 25 | 2 | 0 | Ph | Ph | H | $ClO_4^-$ |
| 26 | 2 | 0 | $CH_2CH_2OCH_3$ | Me | H | $ClO_4^-$ |
| 27 | 2 | 0 | $CH_2CH_2SCH_3$ | Me | H | $ClO_4^-$ |
| 28 | 3 | 0 | Me | Me | Me | $ClO_4^-$ |
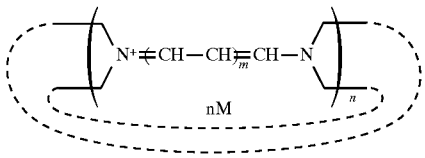
| Compound No. | m | n | M |
|---|---|---|---|
| 29 | 1 | 4 | $Cl^-$ |
| 30 | 1 | 6 | $ClO_4^-$ |
| 31 | 2 | 4 | $Cl^-$ |
| 32 | 2 | 5 | $Cl^-$ |
| 33 | 2 | 6 | $Cl^-$ |

-continued

| | | | |
|---|---|---|---|
| 34 | 3 | 4 | $Cl^-$ |
| 35 | 3 | 6 | $Cl^-$ |

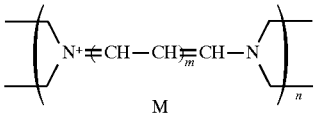

M

| | | | |
|---|---|---|---|
| Compound No. 36 | m = 0 | M = $Cl^-$ | n = 10~20 |
| 37 | m = 1 | M = $ClSO_3^-$ | n = 10~20 |
| 38 | m = 2 | M = $Cl^-$ | n = 10~20 |
| 39 | m = 3 | M = $Cl^-$ | n = 10~20 |

(BOC = $tBuO_2C$)

Compound Nos. 36 to 39 have a ring structure.

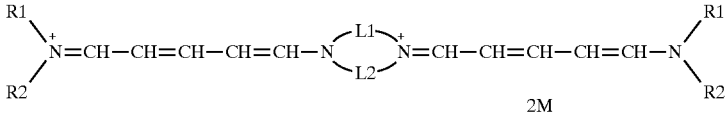

2M

| Compound No. | R1 | R2 | L1 | L2 | M |
|---|---|---|---|---|---|
| 40 | Me | Me | $-CH_2CH_2OCH_2CH_2-$ | $-CH_2CH_2OCH_2CH_2-$ | $ClO_4^-$ |
| 41 | Me | Me | $-CH(CH_3)CH_2-$ | $-CH_2CH_2-$ | $ClO_4^-$ |
| 42 | Me | Me | $-CH(CH_3)CH_2-$ | $-CH(CH_3)CH_2-$ | $ClO_4^-$ |
| 43 | $-CH_2CH=CH_2$ | $-CH_2CH=CH_2$ | $-(CH_2)_3-$ | $-(CH_2)_3-$ | $ClO_4^-$ |
| 44 | Me | Me | $-(CH_2)_4-$ | $-(CH_2)_4-$ | $Cl^-$ |
| 45 | 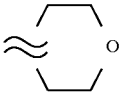 | | $-CH_2CH_2N(CH_3)CH_2CH_2-$ | $-CH_2CH_2N(CH_3)CH_2CH_2-$ | $ClO_4^-$ |
| 46 | 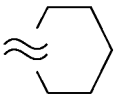 | | 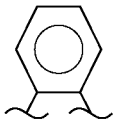 | 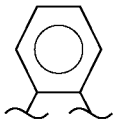 | $Cl^-$ |
| 47 | Me | Me | 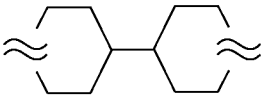 | | $Cl^-$ |
| No. 48 | 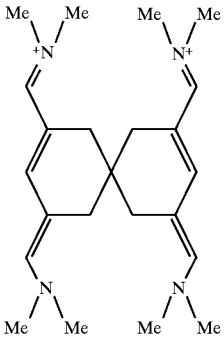 | | | | $2ClO_4^-$ |

"~" represents a linking site.

The compound for use in the present invention can be synthesized according to a method described in, for example, the following literature:

S. S. Malhotra and M. C. Whiting, *J. Chem. Soc.* (1960), page 3812.

Synthetic examples are shown below.

Synthetic Example 1

(Synthesis of Compound 7)

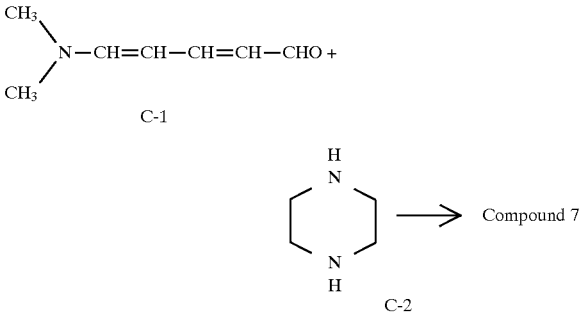

A perchloric acid aqueous solution was added to an ethanol solution of Compound (C-1) and Compound (C-2), and the resultant mixture was stirred for 15 minutes, with heating at 50° C. After cooling, the mixture was filtered. The thus obtained crude crystals were crystallized from a mixed solvent of DMSO, ethyl acetate ester, and hexane. Further, this crystallization was repeated, to obtain the objective Compound 7. Yellow crystal.

λmax=439 nm (MeOH)

Synthetic Example 2

(Synthesis of Compound 15)

Compound 15 was synthesized according to the scheme shown below. Yellow crystal. λmax=457 nm (MEOH)

Synthetic Example 3

(Synthesis of Compound 37)

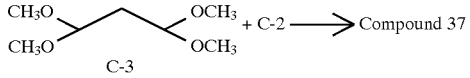

To a DMF solution containing 1.64 g of Compound (C-3) and 0.86 g of Compound (C-2), was added 1.16 g of chlorosulfonic acid, and then refluxing was conducted for 2 hours, with heating. After cooling, crystallization from acetone was performed, to obtain the objective Compound 37. Yield: 1.20 g. λmax=350 nm (MeOH)

Synthetic Example 4

(Synthesis of Compound 38)

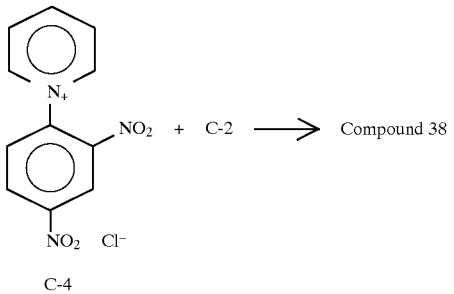

An ethanol solution containing 2.72 g of Compound (C-4) and 0.86 g of Compound (C-2) was refluxed for 15 minutes, with heating. After cooling, the thus obtained crystals were separated by filtration, and then they were crystallized from a mixed solvent of methanol, acetone, and hexane, to obtain an objective Compound 38. Yield: 0.40 g. λmax=484 nm (MeOH).

The timing for adding the methine compound for use in the present invention, as well as other sensitizing dyes, to a silver halide emulsion for use in the present invention, may be at any step of the preparation of the emulsion that has been recognized as being useful. That is, the compound may be added at any timing and steps, as long as it is added before a photographic emulsion is coated. For example, it may be added at the step of the formation of silver halide

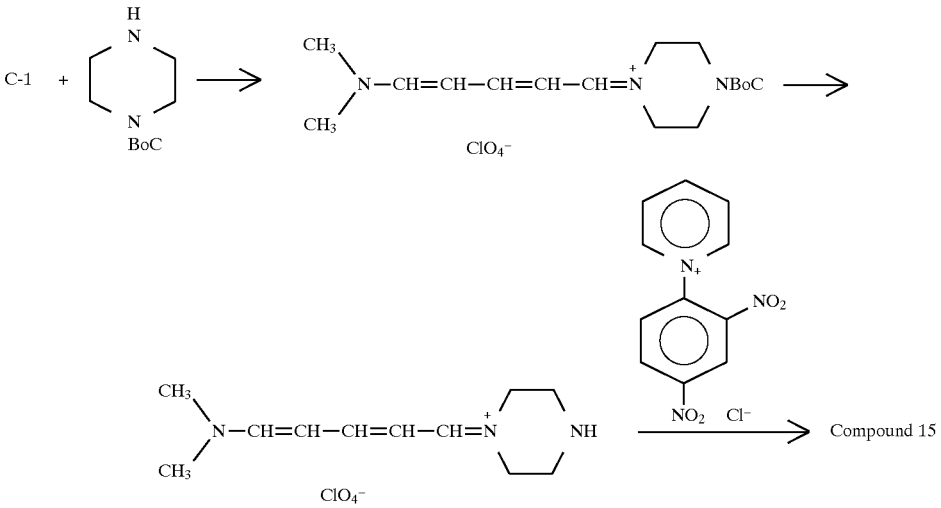

grains or/and at the timing before desalting, or at the step of desalting and/or at the timing of after the desalting, but before the start of chemical ripening, as disclosed in U.S. Pat. Nos. 2,735,766, 3,628,960, 4,183,756, and 4,225,666, and JP-A ("JP-A" means unexamined published Japanese patent application) Nos. 184142/1983 and 196749/1985. Alternatively, the compound may be added just before or at the step of the chemical ripening, or at the timing of after the chemical ripening, but before coating, as disclosed in JP-A No. 113920/1983. Further, the methine compound may be partially added alone, or in a combination with compound(s) having a different structure, at different steps of, for example, during the formation of silver halide grains, and at the step of chemical ripening or after the completion of the chemical ripening; or alternatively before or during chemical ripening, and after completion of the same, as disclosed in, for example, U.S. Pat. No. 4,225,666 and JP-A No. 7629/1983. Further, different kinds of compounds, or different kinds of combinations of compounds, may be added partially at any step prior to coating of the emulsion.

The addition amount of the dye for use in the present invention depends on the form and the size of silver halide grains. Generally, the dye may be used in an amount of $1\times10^{-6}$ to $8\times10^{-3}$ mole, per mole of silver halide. For example, when the size of the silver halide grains is in the range of from 0.2 to 1.3 $\mu$m, the addition amount is preferably from $2\times10^{-6}$ to $3.5\times10^{-3}$ mol, and more preferably from $7.5\times10^{-6}$ to $1.5\times10^{-3}$ mole, per mole of silver halide, respectively.

The dyes for use in the present invention may be dispersed directly in an emulsion. Alternatively, they may be added to an emulsion in the form of a solution of the dye dissolved in a suitable solvent, such as methyl alcohol, ethyl alcohol, methyl cellosolve, acetone, water, and pyridine, or a mixed solvent thereof. At this time, such additives as a base, an acid, and a surfactant may exist together with the dye. Further, ultrasonic wave may be used to prepare the solution. Further, with respect to a method for adding the dye, use can be made of the method in which the said compound is dissolved in a volatile organic solvent, and the resultant solution is dispersed in a hydrophilic colloid, and then the thus obtained dispersion is added to an emulsion, as described in, for example, U.S. Pat. No. 3,469,987; the method in which the said compound is dispersed in an water-soluble solvent, and then the thus obtained dispersion is added to an emulsion, as described in, for example, JP-B ("JP-B" means examined Japanese patent publication) No. 24185/1971; the method in which the methine compound is dissolved in a surfactant, and then the resultant solution is added to an emulsion, as described in, for example, U.S. Pat. No. 3,822,135; the method in which the methine compound is dissolved by virtue of a compound that is able to cause a red shift of the absorption of the methine compound, and then the resultant solution is added to an emulsion, as described, for example, in JP-A No. 74624/1976; and the method in which the methine compound is dissolved in an acid that contains substantially no water, and then the resultant solution is added to an emulsion, as described, for example, in JP-A No. 80826/1975. Further, with respect to other methods for adding a dye to an emulsion, use can be made of the methods described in, for example, U.S. Pat. Nos. 2,912,343, 3,342,605, 2,996,287, and 3,429,835.

The dye according to the present invention can be used as various kinds of filter dyes, irradiation- preventing dyes, or antihalation dyes, for the purpose of improving image sharpness, color separation, and the like.

The dye may be incorporated in a coating solution for a silver halide photographic light-sensitive layer, a filter layer, and/or an antihalation layer, according to a conventional method. The amount of the dye to be used is enough to color a photographic layer. One skilled in the art can easily determine an optimum amount, in accordance with the purpose of the dye to be used. Generally, the dye is preferably used in an amount that will obtain an optical density in the range of from 0.05 to 3.0.

The timing for adding the dye may be at any step prior to coating.

Further, the dye can be localized in a specific layer, by incorporating the dye in a layer together with a polymer (mordant) that has a charge opposite to the ion that the dye has, so that an interaction between the polymer and the dye molecule can be used.

Examples of the polymer mordant include those described in U.S. Pat. Nos. 2,548,564, 4,124,386, 3,625,694, 3,958, 995, 4,168,976, and 3,445,231.

Examples of a supersensitizing agent that is useful for the spectral sensitization according to the present invention include pyrimidylamino compounds, triazinylamino compounds, and azorium compounds, as described, for example, in U.S. Pat. Nos. 3,511,664, 3,615,613, 3,615,632, 3,615,641, 4,596,767, 4,945,038, 4,965,182, and 4,965,182. The supersensitizing agent is also preferably used according to such methods as described in the above-described patents.

The silver halide that can be used in the silver halide light-sensitive material of the present invention may be silver bromide, silver iodobromide, silver iodochlorobromide, silver chlorobromide, or silver chloride. Preferred, of these silver halides, are silver bromide, silver chlorobromide, silver iodochlorobromide, and a high silver chloride described in JP-A No. 42/1990.

Structures of the light-sensitive material and processings for it are described below. The structures and the processings described in JP-A No. 42/1990 are preferably used particularly when the halide of the light-sensitive material is a high silver chloride. On the other hand, the structures and the processings described in JP-A No. 264743/1988 are preferably used particularly when the halide is silver chlorobromide.

The shape of silver halide grains incorporated in the a photographic light-sensitive material may be regular crystals, such as cubic, teteradecahedral, or rhombic dodecahedral crystals; or irregular crystals, such as spherical or tabular crystals; or a mixture of regular and irregular crystals. Further, the grains may be composed of a mixture of grains having various crystal shapes.

The silver halide grains may have phases that are different between the inside and the surface of the grain, or they may be composed of a uniform phase. Further, the silver halide grains may be ones that form latent images predominantly on the surfaces of the grains (e.g. a negative-type light-sensitive material), or ones that form latent images predominantly on the inside of the grains (e.g. an internal latent image-type light-sensitive material), or previously fogged ones (e.g. a direct positive-type light-sensitive material).

Silver halide grains having various kinds of halogen compositions, crystal habits, internal structures, shapes, and distribution, as mentioned above, are used in photographic light-sensitive materials (elements) that are designed for various purposes.

The dyes according to the present invention may be used in light-sensitive materials that are designed for the purposes described below, as a sensitizer, a sensitizing dye, a filter, a halation- or irradiation-preventing agent, and the like. These dyes may be added not only to a light-sensitive emulsion layer but also to any other layers, such as an interlayer, a protective layer, and a backing layer.

The dyes according to the present invention may be used in a variety of silver halide color or black/white photographic light-sensitive materials.

More specifically, they may be used in, for example, a color positive light-sensitive material, a light-sensitive material for color printing paper, a color negative light-sensitive material, a color reversal light-sensitive material that may or may not contain a coupler, a direct positive silver halide photographic light-sensitive material, a photographic light-sensitive material for reprophotography (e.g. a lith film, and a lith duplicate film), a light-sensitive material for a cathode ray tube display, an X-ray recording light-sensitive material (especially, direct radiographic materials and photofluorographic materials employing a screen), a light-sensitive material for a silver salt diffusion transfer process, a light-sensitive material for a color diffusion transfer process, a light-sensitive material for an inhibition process, a light-sensitive material for a silver dye bleaching process, and a heat- development light-sensitive material.

The silver halide photographic emulsion for use in the present invention can be prepared with the method described by, for example, P. Glafkides, in "Chemie et Phisique Photograhique," Paul Montel, 1967; G. F. Duffin, in "Photographic Emulsion Chemistry," The Focal Press, 1966; and V. L. Zelikman et al., in "Making and Coating Photographic Emulsion," The Focal Press, 1964.

Further, at the time of the formation of silver halide grains, a silver halide solvent may be used in order to control the growth of the grains. Examples of the silver halide solvent include ammonia, potassium thiocyanate, ammonium thiocyanate, thioether compounds (e.g. those described in U.S. Pat. Nos. 3,271,157, 3,574,628, 3,704,130, 4,297,439, and 4,276,374), thione compounds (e.g. those described in JP-A Nos. 144319/1978, 82408/1978, and 77737/1980), and amine compounds (e.g. those described in JP-A No. 100717/1979).

At the stage of the formation of silver halide grains, or physical ripening, simple salts or complex salts of a metal different from silver, such as a cadmium salt, a zinc salt, a thallium salt, an irridium salt, or a complex salt thereof; a rhodium salt or complex salt thereof; an iron salt or complex salt thereof, may exist together with a silver halide.

Examples of the internal latent image-type silver halide emulsion for use in the present invention include a conversion-type silver halide emulsion, a core/shell-type silver halide emulsion, and a silver halide emulsion in which a metal different from silver is doped into silver halide grains, as described, for example, in U.S. Pat. Nos. 2,592,250, 3,206,313, 3,447,927, 3,761,276, and 3,935,014.

The silver halide emulsion is generally subjected to chemical sensitization. For the chemical sensitization, use can be made of the method described in, for example, "Die Grundlagen der Photographischen Prozesse mit Silberhalogeniden," edited by H. Frieser, Academische Verlagsgesellschaft (1968), pp 675 to 734.

That is, examples of the chemical sensitization include, for example, sulfur sensitization, using a sulfur-containing compound that is able to react with an active gelatin or silver (e.g. thiosulfates, thioureas, mercapto compounds, and rhodanines); selenium sensitization; reduction sensitization, using a reducing substance (e.g. stannous salts, amines, hydrazine derivatives, formamidine sulfinic acids, and silane compounds); and noble metal sensitization, using a noble metal compound (e.g. gold complex salts, and other complex salts of metal belonging to Group VIII of the Periodic Table, such as Pt, Ir and Pd), which may be employed singly or in combination.

The photographic light-sensitive material for use in the present invention may contain various compounds, for the purpose of preventing the photographic material from being fogged during preparation, storage, or photographic processing of the material, and for stabilizing the photographic properties of the material. That is, many compounds that are known as antifoggants or stabilizers may be used. Examples of such compounds include thiazoles (e.g. benzothiazolium salts described in, for example, U.S. Pat. Nos. 3,954,478 and 4,942,721, and JP-A No. 191032/1984, and their open-ring compounds described in JP-B No. 26731/1984); nitroindazoles, triazoles, benzotriazoles, and benzimidazoles (nitro- or halogen-substituted compounds in particular); heterocyclic mercapto compounds, such as mercapto thiazoles, mercapto benzothiazoles, mercaptobenzimidazoles, mercaptothiadiazoles, mercaptotetrazoles (especially 1-phenyl-5-mercaptotetrazole), and mercaptopyrimidines; the above-described heterocyclic mercapto compounds having a water-soluble group, such as a carboxyl group and a sulfo group; thioketones (e.g. oxazoline thione); azaindenes, such as tetraazaindenes (especially 4-hydroxy-substituted (1,3,3a,7)tetraazaindenes); benzenethiosulfonic acids; benzenesulfinic acids; and acetylene compounds described in JP-A No. 87957/1987.

The silver halide photographic light-sensitive material of the present invention may contain color couplers, such as a cyan coupler, a magenta coupler, and a yellow coupler, and a compound that is used for dispersion of the coupler.

That is, the photographic light-sensitive material may contain a compound that is capable of coloring upon an oxidation coupling reaction with an aromatic primary amine developing agent (e.g. phenylenediamine derivatives and aminophenol derivatives) in the color development processing. Examples of the magenta coupler include 5-pyrazolone couplers, pyrazolobenzimidazole couplers, cyanoacetylcoumarone couplers, and open-chain acylacetonitrile couplers. Examples of the yellow coupler include acylacetoamide couplers (e.g. benzoylacetanilides and pyraroylacetanilides). Examples of the cyan coupler include naphthol couplers and phenol couplers. Preferably, the couplers have in their molecule a hydrophobic group, which is called a ballasting group, so that they are nondiffusing. The coupler may be 4-equivalent or 2-equivalent to the silver ion. Further, the coupler may be a colored coupler that effects color correction, or a coupler that releases a development inhibitor upon development (a so-called DIR coupler).

Further, in addition to or in place of the DIR coupler, the photographic light-sensitive material may contain a non-coloring DIR coupling compound that forms a colorless product, and that releases a development inhibitor, upon a coupling reaction.

The photographic light-sensitive material of the present invention may contain polyalkylene oxides, and derivatives thereof, such as ethers, esters, and amines; thioether compounds, thiomorpholines, quarternary ammonium chloride, urethane derivatives, urea derivatives, imidazole derivatives, 3-pyrazolidones, and the like, in order to increase sensitivity and contrast, or to accelerate development.

The silver halide light-sensitive material of the present invention may contain various kinds of dyes in addition to the methine compound for use in the present invention, as a filter dye, or for prevention of irradiation, or for other various purposes.

Examples of such dyes include oxonol dyes having a pyrazolone nucleus or a barbituric acid nucleus, as described in, for example, British Patent Nos. 506,385, 1,177,429, 1,311,884, 1,338,799, 1,385,371, 1,476,214, 1,433,102, and 1,553,516, JP-A Nos. 85130/1973, 114420/1974, 117123/1977, 161233/1980, and 111640/1984, JP-B Nos. 22069/1964, 13168/1968, and 273527/1987, and U.S. Pat. Nos. 3,247,127, 3,469,985, and 4,078,933; other oxonol dyes described in, for example, U.S. Pat. Nos. 2,533,472 and 3,379,533, British Patent No. 1,278,621, and JP-A Nos. 134447/1989 and 183652/1989; azo dyes described in, for example, British Patent Nos. 575,691, 680,631, 599,623, 786,907, 907,125, and 1,045,609, U.S. Pat. No. 4,255,326, and JP-A No. 211043/1984; azomethin dyes described in, for example, JP-A Nos. 100116/1975 and 118247/1979, and British Patent Nos. 2,014,598 and 750,031; anthraquinone dyes described in U.S. Pat. No. 2,865,752; arylidene dyes described in, for example, U.S. Pat. Nos. 2,533,009, 2,688,541, and 2,538,008, British Patent Nos. 584,609 and 1,210,252, JP-A Nos. 40625/1975, 3623/1976, 10927/1976, and 118247/1979, and JP-B Nos. 3286/1973 and 37303/1984; styryl dyes described in, for example, JP-B Nos. 3082/1953, 16594/1969, and 28898/1984; triarylmethane dyes described in, for example, British Patent Nos. 446,583 and 1,335,422, and JP-A No. 228250/1984; merocyanine dye described in, for example, British Patent Nos. 1,075,653, 1,153,341, 1,284,730, 1,475,228, and 1,542,807; and cyanine dyes described in, for example, U.S. Pat. Nos. 2,843,486 and 3,294,539, and JP-A No. 291247/1989.

In order to prevent such dyes from diffusion, use can be made of the methods described below.

For example, a method in which a dissociated anionic dye is incorporated in the same layer, together with a hydrophilic polymer that has a charge opposite to the dye therein, and that acts as a mordant, so that the dye is localized in the particular layer by an interaction between the dye molecule and the polymer, is disclosed in, for example, U.S. Pat. Nos. 2,548,564, 4,124,386, and 3,625,694.

Further, a method for dyeing a particular layer by the use of a water-insoluble solid dye, is disclosed in, for example, JP-A Nos. 12639/1981, 155350/1980, 155351/1980, 27838/1988, and 197943/1988, and European Patent No. 15,601.

Further, a method for dyeing a particular layer by the use of metal salt fine particles having dyes adsorbed thereon, is disclosed in, for example, U.S. Pat. Nos. 2,719,088, 2,496,841, and 2,496,843, and JP-A No. 45237/1985.

The photographic light-sensitive material of the present invention may contain various kinds of surfactants for various purposes, such as coating aid, antistatic, improvement of sliding (slip), emulsification and dispersion, prevention of adhesion, and improvement of photographic properties (e.g. development acceleration, high contrast, and sensitization).

When the present invention is practically used, other additives may be used with a silver halide emulsion, or with other hydrophilic colloids. Examples of such additives include an anti-fading agent, an inorganic or organic hardener, an anti-fogging agent, an ultraviolet ray-absorbing agent, a mordant, a plasticizer, a latex polymer, and a matting agent. Specific examples of these additives are described in, for example, *Research Disclosure*, Vol.176 (1978, XI), D-17643.

Further, in the photographic light-sensitive material for use in the present invention, a hydrophilic polymer, such as gelatin, may be used as a protective colloid.

A finished silver halide emulsion and the like are coated on a suitable support, examples of which include a baryta paper, a resin-coated paper, a synthetic paper, a triacetate film, a polyethyleneterephthalate film, and other plastic bases; and a glass plate.

In order to obtain a photographic image, exposure to light can be performed according to a conventional method. In other words, for this purpose, use can be made of any of various known light sources, such as natural light (sunlight), a tungsten lamp, a fluorescent lamp, a mercury lamp, a xenon arc lamp, a carbon arc lamp, a xenon flash lamp, and a cathode ray tube flying spot. With respect to an exposure time, not only an exposure time of from 1/1000 sec. to 1 sec., as is usually applied for a camera, but also an exposure time of less than 1/1000 sec., for example from $1/10^4$ to $1/10^6$ sec. by means of a xenon flash lamp or a cathode ray tube, can be employed. Further, an exposure time of not less than 1 sec can also be applied. Optionally, the spectral composition of light that is used for exposure may be controlled by the use of a color filter. A laser light may be used for exposure to light. Further, exposure may be performed using a light that is emitted from a fluorescent substance that is excited by electronic rays, X rays, $\gamma$ rays, $\alpha$ rays, or the like.

For the photographic processings of the light-sensitive material of the present invention, any of known methods and known processing solutions, as described, for example, in Research Disclosure, Vol. 176, pages 28–30, (RD-17643), may be employed. The photographic processings may be a photographic processing for forming a silver image (i.e. a black/white photographic processing), or a photographic processing for forming a color image (i.e. a color photographic processing), according to the purpose. The processing temperature is usually set in a range of from 18° C. to 50° C. However, the processing may be performed at a temperature lower than 18° C., or alternatively at a temperature over 50° C.

The present invention may be applied to a silver halide photographic light-sensitive material having a transparent magnetic recording layer. A silver halide photographic light-sensitive material carrying magnetic records, that may be used in the present invention, can be prepared by a method in which ferromagnetic particles described in JP-A Nos. 23505/1984, 195726/1992, and 59357/1994 are coated on the following support. Preferably, the support can be produced by a method in which a pre-heat-treated thin- layer polyester support, as described in detail in JP-A Nos. 35118/1994 and 17528/1994, and KOKAIGIHO 94–6023 (HATSUMEI KYOKAI), an example of which is a polyethylene-aromatic dicarboxylate-series polyester support of generally from 50 $\mu$m to 300 $\mu$m, preferably from 50 $\mu$m to 200 $\mu$m, more preferably from 80 to 115 $\mu$m, and particularly preferably from 85 $\mu$m to 105 $\mu$m thickness, is subjected to heat treatment (annealing), at a temperature of from 40° C. to the glass transition temperature, for 1 to 1500 hours, and then such an annealed support is further subjected to a surface treatment, such as ultraviolet ray irradiation, as described in JP-B Nos. 2603/1968, 2604/1968, and 3828/1970, corona discharge, as described in JP-B No. 5043/1973 and JP-A No. 131576/1976, and glow discharge, as described in JP-B Nos. 7578/1960 and 43480/1971, followed by a coating of a subbing layer, as described in U.S. Pat. No. 5,326,689, and if necessary a coating of an underlayer, as described in U.S. Pat. No 2,761,791.

The above-mentioned magnetic layer may be a striped form, as described in JP-A Nos. 124642/1992 and 124645/1992.

Further, if necessary, the above-described support is subjected to an antistatic treatment as described in JP-A No. 62543/1992, and finally at least one silver halide emulsion is coated thereon. Examples of the above-described silver halide emulsion to be used are those described in JP-A Nos. 166932/1992, 41436/1991, and 41437/1991.

Preferably, the thus-produced light-sensitive material is manufactured according to the method of production management described in JP-B No. 86817/1992, and production data are recorded according to the method described in JP-B No. 87146/1994. After that, or before that, in accordance with the method described in JP-A No. 125560/1992, the material is cut into a film whose width is narrower than the conventional 135 size, and for the perforation, two holes are made at one side of the film, per picture of small format, so that the perforation goes well with a picture of smaller format than the conventional one.

The thus-manufactured film can be encased to be used in a cartridge (magazine) package described in JP-A No. 157459/1992, a cartridge illustrated in FIG. 9 shown in Example of JP-A No. 210202/1993, a film patrone described in U.S. Pat. No. 4,221,479, or a cartridge described in U.S. Pat. Nos. 4,834,306, 4,834,366, 5,226,613, and 4,846,418.

Preferred of these film cartridges and film patrones for use in the present invention, from the viewpoint of light shielding, are those in which the tongue is contained (encased), as described in U.S. Pat. Nos. 4,848,693, and 5,317,355.

Further, a cartridge having a lock machinery, as described in U.S. Pat. No. 5,296,886; a cartridge in which the state of use of a film is indicated, as described in U.S. Pat. No. 5,347,334; and a cartridge having a double exposure-preventing function, are preferred.

Further, use can be made of a cartridge in which a film is easily encased by simply inserting the film in the cartridge, as described in JP-A No. 85128/1994.

The thus-produced film cartridge can be used according to the purpose for photographing, development processing, and various kinds of pleasure (enjoyment) of photography, by means of cameras, a developing apparatus (a processor), or other Labo machines, as described below.

The function of a film cartridge (patrone) can be fully demonstrated by cameras that are exemplified by a simple loading-type camera, as described in JP-A Nos. 8886/1994 and 99908/1994; an auto winding-type camera, as described in JP-A Nos. 57398/1994 and 101135/1994; a camera from which a film can be taken out to exchange the film in the middle of photographing, as described in JP-A No. 205690/1994; a camera capable of recording, on a magnetic recording layer of the film, such information, at the time of photographing, as panorama photographing, high-vision photographing, and ordinary photographing (capable of recording magnetic information by which the print aspect ratio can be selected), as described in JP-A Nos. 293138/1993 and 283382/1993; a camera having a double exposure-preventing function, as described in JP-A No. 101194/1994; and a camera having a function by which the state of use of a film and the like can be displayed, as described in JP-A No. 150577/1993.

The thus-photographed films may be processed by an auto processor, as described in JP-A Nos. 222514/1994 and 222545/1994. Alternatively, before, or in the middle of, or after the processing of the film, a method of taking advantage of a magnetic recording on the film, as described in JP-A Nos. 95265/1994 and 123054/1992, may be used. The function by which the aspect ratio can be selected, as described in JP-A No. 19364/1993, may be used.

For the Cine-type development, the photographed film is spliced to process according to a method described in JP-A No. 119461/1993 when developed.

Further, at the time of development processing, or after that, an attach and detach processing, as described in JP-A No. 148805/1994, can be used.

After the above-described processing has finished, according to the methods described in JP-A Nos. 184835/1990, 186335/1992, and 79968/1994, a back print and a front print may be performed on a color paper, and after that, film information may be converted to the print.

Further, an index print, as described in JP-A Nos. 11353/1993 and 232594/1993, with the used cartridge, may be returned to a customer.

The compounds for use in the present invention provide high absorptivity in a silver halide emulsion.

EXAMPLE

Now, the present invention is described in more detail with reference to the following examples, but the present invention is not limited to these.

EXAMPLE 1

Preparation of Emulsion A

Preparation of {100} AgCl tabular emulsion 42.7 liters of an aqueous gelatin solution (containing 526.5 g of gelatin-1 (deionized alkali -processed bone gelatin having a methionine content of about 40 $\mu$mol/g) and 211 ml of a 1N $HNO_3$ solution; pH 4.3) and 351 ml of NaCl-1 solution (containing 10 g of NaCl in 100 ml), were placed in a reaction vessel, and 421 ml of Ag-1 solution (containing 20 g of $AgNO_3$ in 100 ml) and 421 ml of X-1 solution (containing 7.05 g of NaCl in 100 ml) were added, at a rate of 1685 ml/min, in a double jet manner, with the temperature kept at 40° C. After 3 min of stirring, 761 ml of Ag-2 solution (containing 2 g of $AgNO_3$ in 100 ml) and 761 ml of X-2 solution (containing 1.4 g of KBr in 100 ml) were mixed in, at a rate of 2176 ml/min, in a double jet manner. After 3 min of stirring, 1264 ml of Ag-1 solution and 1264 ml of X-1 solution were added, at a rate of 1685 ml/min, in a double jet manner. After 2 min of stirring, 5481 ml of an aqueous gelatin solution (containing 351 g of acid processed gelatin-1, 35 g of NaCl, and a iN NaOH solution necessary to adjust pH to 5.5) was added, to bring pCl to 1.8, and the temperature was elevated to 75° C., to adjust pCl to 1.8, followed by ripening for 5 min. Thereafter, Disulfide compound A was added in an amount of $1\times10^{-4}$ mol, per mol of the silver halide, and further an AgCl fine-grain emulsion (having an average grain diameter of 0.1 $\mu$m) was added, with setting an AgCl addition rate to $7.24\times10^{1}$ mol/min, for 20 min. After 10 minutes of ripening followed to the addition, a settling agent was added, and the temperature was lowered to 35° C., followed by settling and washing with water. An aqueous gelatin solution was added, and the pH was adjusted to 6.0, at 60° C.

Disulfide compound A

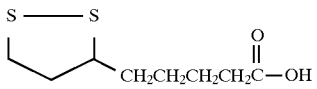

The transmission-type electron microscope image (hereinafter referred to as TEM image) of a replica of the grains was observed. The obtained emulsion was high-silver chloride {100} tabular grains containing 0.44 mol% of AgBr based on silver. The form (shape) characteristic values of the grains were as follows:

(The total projected area of tabular grains whose aspect ratio was not less than 2 The total project area of the total AgX grains)×100=$a_1$=90

(The average aspect ratio (average diameter average thickness) of the tabular grains)=$a_2$=9.3

(The average diameter of the tabular grains)=$a_3$ =1.67 ($\mu$m)

(The average thickness)=$a_4$=0.18 ($\mu$m) (Deviation coefficient in terms of the diameter of a circle equivalent to the project area of the individual grain)=$a_5$=20

Preparation of Emulsion B

Preparation of {100} AgBrCl tabular emulsion 42.6 liters of an aqueous gelatin solution (containing 526.5 g of gelatin-1 (deionized alkali-processed bone gelatin having a methionine content of about 40 $\mu$mol/g) and 211 ml of an 1N $HNO_3$ solution; pH 4.3) and 351 ml of NaCl-1 solution (containing 10 g of NaCl in 100 ml), were placed in a reaction vessel, and 421 ml of Ag-1 solution (containing 20 g of $AgNO_3$ in 100 ml) and 421 ml of X-1 solution (containing 7.05 g of NaCl in 100 ml) were added, at a rate of 1685 ml/min, in a double jet manner, with the temperature kept at 40° C. After 3 min of stirring, 761 ml of Ag-2 solution (containing 2 g of $AgNO_3$ in 100 ml) and 761 ml of X-2 solution (containing 1.4 g of KBr in 100 ml) were mixed in, at a rate of 2176 ml/min, in a double jet manner. After 3 min of stirring, 1264 ml of Ag-1 solution and 1264 ml of X-1 solution were added, at a rate of 1685 ml/min, in a double jet manner. After 2 min of stirring, 5481 ml of an aqueous gelatin solution (containing 351 g of gelatin-1, 35 g of NaCl, and a 1N NaOH solution necessary to adjust pH to 5.5) was added, to bring pCl to 1.8, and the temperature was elevated to 75° C., to adjust pCl to 1.8, followed by ripening for 5 min. Thereafter, AgBrCl fine-grains (Br content of 60%) having an average grain diameter of 0.07 $\mu$m were allowed to grow-up, with setting an addition rate of silver nitrate to $7.24\times10^{-1}$ mol/min, for 20 min.

After 10 minutes of ripening followed to the addition, a settling agent was added, and the temperature was lowered to 35° C., followed by settling and washing with water. An aqueous gelatin solution was added, and the pH was adjusted to 6.0, at 60° C. The transmission- type electron microscope image (hereinafter referred to as TEM image) of a replica of the grains was observed. The obtained emulsion was silver chlorobromide {100} tabular grains containing about 53 mol% of AgBr based on silver. The form (shape) characteristic values of the grains were $a_1$=85, $a_2$=9.2, $a_3$=1.66, $a_4$=0.18, and $a_5$=21.

This emulsion B was subjected to desalting processing by the use of flocculation. After that, 62 g of gelatin and 1.75 g of phenoxyethanol were added to the emulsion, and then the pH value and the pAg value of the resultant emulsion were adjusted to 6.0 and 7.5, respectively.

Chemical sensitization

The thus-prepared emulsion B was subjected to chemical sensitization, as described below, with stirring, under the optimum condition that the temperature of the emulsion was kept at 56° C.

First, Thiosulfonic acid compound-1 was added to the emulsion, in the amount of $6\times10^{-5}$ mol, per mol of silver halide, and then, to the emulsion, AgBr fine grains, whose average diameter of spheres equivalent to the volume of the individual grain was 0.05 $\mu$m, were added, in the amount of 1.0 mol%, per mol of silver halide, followed by ripening for about 5 minutes. Further, a 1% aqueous solution of KI was added to the emulsion, in the amount of 0.2 mol%, per mol of silver halide.

Further, 3 minutes later, $1\times10^{-6}$ mol/mol of Ag of thiourea dioxide was added to the emulsion, and then the mixture was allowed to stand for 22 minutes, to effect reduction sensitization.

After that, to the reduction sensitized emulsion, 4-hydroxy-6-methyl-1,3,3a,7-tetraazaindene was added, in the amount of 1.5×10–4 mol, per mol of silver halide, followed by sodium thiosulfate and Selenium compound-1, in the amounts of $1\times10^{-5}$ mol and $2\times10^{-6}$ mol, per mol of silver halide, respectively, and then chloroauric acid and potassium thiocyanate were added, in the amounts of $2.7\times10^{-6}$ mol and $1.8\times10^{-3}$ mol, per mol of silver halide, respectively.

Further, nucleic acid (Trade name RNA-F, manufactured by Sanyo-kokusaku Pulp Co.) was added to the emulsion, in the amount of 67 mg, per mol of silver halide. Then, 20 minutes after the addition of chloroauric acid, sodium sulfite was added to the emulsion, in the amount of $3.2\times10^{-4}$ mol, per mol of silver halide, followed by further ripening. Further, 5 minutes after the addition of sodium sulfite, nothing was added to the emulsion, but 80 minutes after the addition of chloroauric acid, a water-soluble mercapto compound-1 was added thereto, and then the mixture was cooled to 35° C., to prepare an emulsion for Sample (101). On the other hand, an emulsion for Sample (102) was prepared in the same manner as the emulsion for Sample (101) except that, Compound No. 37 according to the present invention was added to the emulsion in the amount of $5\times10^{-3}$ mol, per mol of silver halide, and then, 80 minutes after the addition of chloroauric acid, the water-soluble mercapto compound-1 was added thereto, and then the mixture was cooled to 35° C.

Thus, the preparation (chemical ripening) of the emulsion was completed. Thiosulfonic acid compound-1

$C_2H_5SO_2SNa$

Selenium compound-1

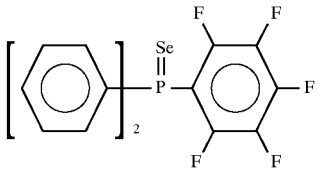

Water-soluble mercapto compound-1

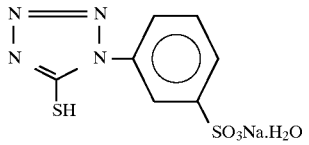

Preparation of emulsion-coating layer

To the chemically sensitized emulsion, the compounds shown below were added, in the amounts shown below, per mol of silver halide, to prepare an emulsion-coating solution.

| | |
|---|---|
| Gelatin (gelatin that was already contained in the emulsion was included) | 111 g |
| Dextran (average molecular weight, 39,000) | 21.5 g |
| Sodium polyacrylate (average molecular weight, 400,000) | 5.1 g |
| Sodium polystyrenesulfonate (average molecular weight, 600,000) | 1.2 g |
| Hardener 1,2-Bis(vinylsulfonylacetamide)ethane | * |
| Compound-I | 42.1 mg |

-continued

| | |
|---|---|
| Compound-II | 10.3 g |
| Compound-III | 0.11 g |
| Compound-IV | 8.5 mg |
| Compound-V | 0.43 g |
| Compound-VI | 0.004 g |
| Compound-VII | 0.1 g |
| Compound-VIII | 0.1 g |
| Adjusted to pH 6.1 using NaOH | |

Compound-I

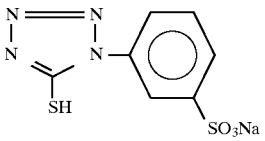

Compound-II

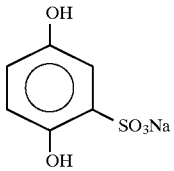

Compound-III

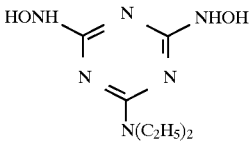

Compound-IV

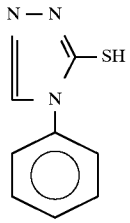

Compound-V

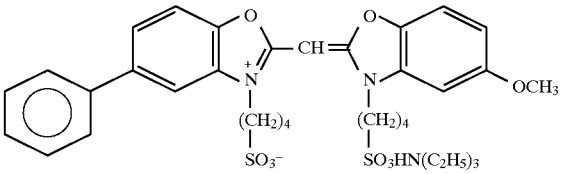

Compound-VI

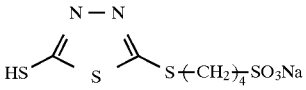

Compound-VII

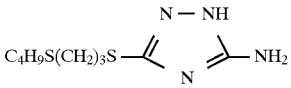

Compound-VIII

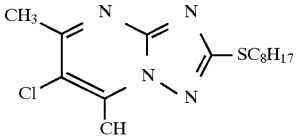

*The addition amount was adjusted, so that the value of 230% in terms of the degree of swelling would be obtained.

To the above-described coating solution, the following Dye emulsion S was added, so that each of ultraviolet ray-absorbing dye-I to dye-III was coated in the amount of 5 mg/m$^2$ on one side of a support. Ultraviolet ray-absorbing dye-I Ultraviolet ray-absorbing dye-I

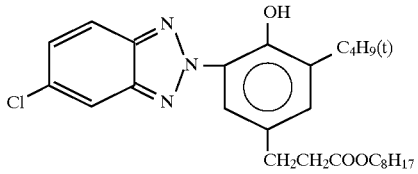

Ultraviolet ray-absorbing dye-II

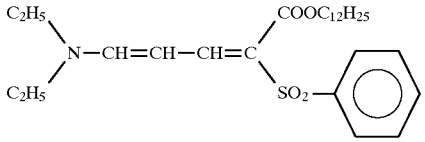

Ultraviolet ray-absorbing dye-III

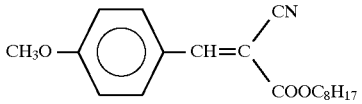

Preparation of Dye emulsion S 20 g of each of the above-described dye-I, dye-II, and dye-III, 62.8 g of each of high-boiling-point organic solvent-I and -II, each illustrated below, and 333 g of ethyl acetate were dissolved at 60° C., to obtain a solution. To the solution, 65 ml of a 5% aqueous solution of sodium dodecylsulfonate, 94 g of gelatin, and 581 ml of water were added, and then the resultant mixture was emulsified and dispersed at 60° C. for 30 minutes by means of Dissolver. After that, 2 g of Compound-IX, illustrated below, and 6 liters of water were added to the resultant emulsion dispersion, and then the temperature of the dispersion was lowered to 40° C. Then, the dispersion was condensed, until the net amount was reduced to 2 kg, by means of an ultrafilter Labomodule ACP 1050, manufactured by Asahi Chemical Industry Co., Ltd., and then 1 g of Compound-IX was added to the condensed dispersion, to obtain Dye emulsion S.

High-boiling point organic solvent-I

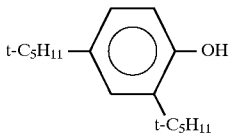

High-boiling-point organic solvent-II

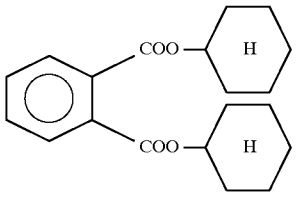

-continued

Compound-IX

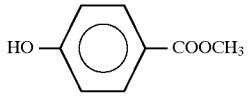

Preparation of coating solution for surface-protective layer

The coating solution for a surface-protective layer was prepared, so that each component was coated in the following amounts:

| | |
|---|---|
| Gelatin | 0.780 g/m$^2$ |
| Sodium polyacrylate (average molecular weight, 400,000) | 0.035 g/m$^2$ |
| Sodium polystyrenesulfonate (average molecular weight, 600,000) | 0.0012 g/m$^2$ |
| Polymethyl methacrylate (average grain diameter, 3.7 $\mu$m) | 0.072 g/m$^2$ |
| Coating aid-I | 0.020 g/m$^2$ |
| Coating aid-II | 0.037 g/m$^2$ |
| Coating aid-III | 0.0080 g/m$^2$ |
| Coating aid-IV | 0.0032 g/m$^2$ |
| Coating aid-V | 0.0025 g/m$^2$ |
| Compound-VII | 0.0022 g/m$^2$ |
| 1,2-Benzisothiazoline-3-one | 0.0010 g/m$^2$ |
| Adjusted to pH 6.8 using NaOH | |

Coating aid-I

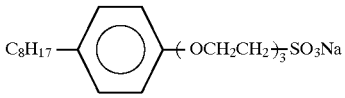

Coating aid-II $C_{16}H_{33}O(CH_2CH_2O)_{10}H$

Coating aid-III $C_{17}H_{33}CON(CH_3)CH_2CH_2SO_3Na$

Coating aid-IV $C_8F_{17}SO_2N(C_3H_7)(CH_2CH_2O)_{15}H$

Coating aid-V $C_8F_{17}SO_2N(C_3H_7)(CH_2CH_2O)_4(CH_2)_4SO_3Na$

Compound-VII

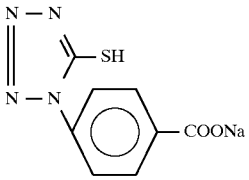

Preparation of support (1) Preparation of Dye dispersion B for a subbing layer

Dye-II, illustrated below, was subjected to a ballmill treatment according to the method described in JP-A No. 197943/1988.

Dye-II

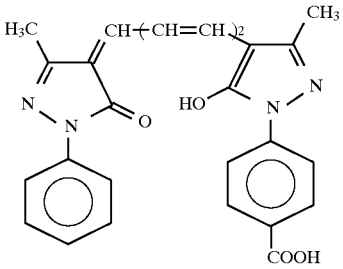

434 ml of water, and 791 ml of a 6.7% aqueous solution of Triton X 200 (registered trademark), as a surface-active agent (TX-200 (registered trademark)), were contained in a ballmill, whose content was 2 liters. 20 g of the dye was added to this solution. After that, 400 ml of beads of zirconium dioxide ($ZrO_2$) (diameter 2 mm) was added to the resultant liquid, and then the contents were pulverized for 4 days. Then, 160 g of a 12.5% aqueous solution of gelatin was added to the liquid. After defoaming, the beads of $ZrO_2$ were removed by filtration. As a result of observation of the thus-obtained dye dispersion, it was found that the grain diameter of the pulverized dye was distributed in a wide range, of from 0.05 to 1.15 $\mu$m, and the average grain size was 0.37 $\mu$m.

Further, dye particles, each of size of not smaller than 0.9 $\mu$m, were removed according to a centrifugal separating operation.

Thus, Dye dispersion B was obtained.

(2) Preparation of support

A biaxially stretched polyethylene terephthalate film of 175 $\mu$m thickness, was subjected to a corona discharge treatment, and then a solution for the first subbing layer, having the composition described below, was coated on one side of the film by means of a wire-converter, so that the coated amount was 4.9 ml/m$^2$, followed by drying at 185° C. for one minute.

After that, similarly to the above-described method, the first subbing layer was coated on the other side of the film. Polyethylene terephthalate containing 0.06 wt% of Dye-IV and 0.06 wt% of Dye-V was employed.

Dye-IV

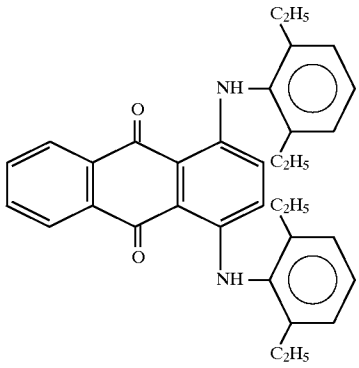

-continued

Dye-V

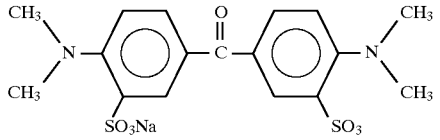

| | |
|---|---|
| Butadiene-styrene copolymer latex solution (Solid content 40%, butadiene/styrene = 31/69 (weight ratio)) | 158 ml |
| 4% solution of sodium 2,4-dichloro-6-hydroxy s-triazine | 41 ml |
| Distilled water | 801 ml |

In the latex solution, 0.4 wt% of the compound illustrated below, based on the solid content of the latex, was contained as an emulsifying dispersant.

(Emulsifying dispersant)

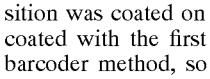

This compound was contained such that its amount would be 0.4 wt %, based on the solid content of the latex.

(3) Coating of subbing layer

The second subbing layer having the following composition was coated on each side of the above-described film coated with the first subbing layers, according to a wire-barcoder method, so that the coating amounts were those described below. Then, the thus-obtained subbing layers were dried at 155° C.

| | |
|---|---|
| Gelatin | 80 mg/m$^2$ |
| Dye dispersion B (as a solid content of dye) | 8 mg/m$^2$ |
| Coating aid-VI | 1.8 mg/m$^2$ |
| Compound-XI | 0.27 mg/m$^2$ |
| Matting agent: Polymethyl methacrylate (average grain diameter, 2.5 $\mu$m)) | 2.5 mg/m$^2$ |
| Coating aid-VI $C_{12}H_{25}O(CH_2CH_2O)_{10}H$ | |
| Compound-XI | 0.27 mg/m$^2$ |

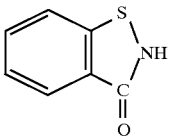

Preparation of photographic light-sensitive material

On both sides of the thus-prepared support, the combination of the emulsion layer and the surface-protective layer, all of which were described above, was coated according to a simultaneous extrusion method. The coating amount of silver was 0.80 g/m$^2$, on each side.

Evaluation of photographic properties

Both sides of the thus prepared photographic light-sensitive material were contacted and bound with two sheets of Ultravision First Detail (trade name, manufactured by Du Pont), and exposure to light of 0.05 seconds was given thereto, from both side directions. The exposed light-sensitive material was subjected to X-ray sensitometry.

Regulation of the exposure was performed by varying the distance between the X-ray tube and the cassette. After the exposure to light, the light-sensitive material was subjected to an automatic processing with a developing solution and a fixing solution, each of which is described below. Sensitivity was represented in terms of the relative value, assuming Sample (101) as standard, by the difference of exposure amounts required to give a prescribed density at a prescribed time. In concrete, the relative value in sensitivity was represented by Δlog E obtained by an equation: Δlog E=log [(Sample 101)/(Sample 102)], wherein Δlog E was the difference of exposure amounts (E) for each sample in logarithm to give a density of 0.1 at a exposure time of 0.05 sec. The results are shown in Table 1.

Processing

Autoprocessor . . . CEPROS-30, manufactured by Fuji Photo Film Co., Ltd.

Preparation of condensed solution

| | |
|---|---|
| Part A | |
| Potassium hydroxide | 18.0 g |
| Potassium sulfite | 30.0 g |
| Sodium carbonate | 30.0 g |
| Diethylene glycol | 10.0 g |
| Diethylenetriaminepentaacetic acid | 2.0 g |
| 1-(N,N-Diethylamino)ethyl-5-mercaptotetrazole | 0.1 g |
| L-Ascorbic acid | 43.2 g |
| 4-Hydroxymethyl-4-methyl-1-phenyl-3-pyrazolidone | 2.0 g |
| Water to make 300 ml | |
| Part B | |
| Triethylene glycol | 45.0 g |
| 3,3'-dithio-bis(hydrocinnamic acid) | 0.2 g |
| Glacial acetic acid | 5.0 g |
| 5-Nitroindazole | 0.3 g |
| 1-Phenyl-3-pyrazolidone | 3.5 g |
| Water to make 60 ml | |
| Part C | |
| Glutaraldehyde (50%) | 10.0 g |
| Potassium bromide | 4.0 g |
| Potassium methabisulfite | 10.0 g |
| Water to make 50 ml | |

Water was added to a mixture of 300 ml of Part A, 60 ml of Part B, and 50 ml of Part C, to make 1 liter, and then the pH value of the solution was adjusted to 10.90.

A CE-DF1 bottle, manufactured by Fuji Photo film Co., Ltd., was filled with 4.5 liters of Part A, 0.90 liters of Part B, and 0.75 liters of Part C, and this mixture solution was used as a development replenisher for 1.5 liters of the used solution.

Development initiator

Acetic acid was added to the above-described development replenisher, in order to adjust the pH value of the solution to 10.20. The resultant solution was used as a development initiator.

| Fixing solution | |
|---|---|
| Ammonium thiosulfate (70 wt/vol %) | 3000 ml |
| Disodium ethylenediaminetetraacetate.dihydrate | 0.45 g |
| Sodium sulfite | 225 g |
| Boric acid | 60 g |
| 1-(N,N-Diethylamine)-ethyl-5-mercaptotetraazole | 15 g |
| Tartaric acid | 48 g |
| Glacial acetic acid | 675 g |
| Sodium hydroxide | 225 g |
| Sulfuric acid (36N) | 58.5 g |
| Aluminum sulfate | 150 g |
| Water to make | 6000 ml |
| pH | 4.68 |

Further, an actinomycetes, as a fur-preventing agent, was applied to perlites of average grain size 100 $\mu$m, and of average aperture size 3 μm. 0.4 g of the perlites having the actinomycetes carried thereon and/or therein, was filled into each of three bottles made of polyethylene, whose opening part was covered with a 300 mesh nylon sheet, from which water and fungi would come and go (circulate). Of the three bottles, two bottles were sunk to the bottom of a washing bath, while the third was sunk to the bottom of a stock tank (liquid content 0.2 liter) for a washing water.

| Processing speed and Processing temperature | | |
|---|---|---|
| Development | 35° C. | 8.8 sec |
| Fixing | 32° C. | 7.7 |
| Washing | 17° C. | 3.8 |
| Squeezing | | 4.4 |
| Drying | 58° C. | 5.3 |
| Total | | 30 |

| Replenishing amount | |
|---|---|
| Developing solution | 8 ml/10 × 12 inch |
| Fixing solution | 8 ml/10 × 12 inch |

As is apparent from the results shown in Table 1, it can be seen that photographic speed was much improved when a compound for use in the present invention was added to a photographic light-sensitive material.

TABLE 1

| Sample No. | Compound | Sensitivity (Δlog E) | Note |
|---|---|---|---|
| 101 | — | 0 (standard) | Comparative example |
| 102 | No. 37 | +0.10 | This invention |

With reference to the absorption spectrum that was obtained by subjecting a reflection spectrum to Kubelka-Munk conversion, and then plotting the axis of abscissa with the energy value, the value (S), obtained by integrating an absorption in the wavelength region longer than 340 nm, was measured, with respect to each of the above-described samples. As a result, the ratio of the value S of Sample (102) to the value S of Sample (101) was 1.40, assuming Sample (101) as the standard. Accordingly, it was found that the absorptivity of the silver halide emulsion for use in Sample (102) was much improved.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide light-sensitive materal, comprising a light-sensitive silver halide emulsion layer containing a methine compound represented by formula (1):

formula (1)

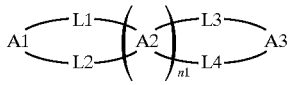

wherein A1, A2, and A3 each represent a strepocyanine dye; L1, L2, and L4 each represent a divalent linking group, and n1 represents an integer of not less than 0;

wherein the strepocyanine dye is represented by formula (3):

formula (3)

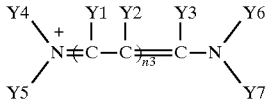

wherein Y1, Y2, and Y3 each represent a hydrogen atom, an alkyl group having 1 to 20 carbon atoms, an aryl group having 6 to 20 carbon atoms, an alkoxy group having 1 to 20 carbon atoms, or an aryloxy group having 6 to 20 carbon atoms; Y4, Y5, Y6 and Y7 each represent a hydrogen atom, an alkyl group having 1 to 20 carbon atoms, or an aryl group having 6 to 20 carbon atoms; and n3 represents an integer of not less than 0.

2. The silver halide light-sensitive material as claimed in claim 1, wherein L1, L2, L3, and L4 each represent an alkylene group, an alkenylene group, or an alkinylene group.

3. The silver halide light-sensitive material as claimed in claim 1, wherein n1 represents an integer of not more than 1,000.

4. The silver halide light-sensitive material as claimed in claim 1, wherein the methine compound is selected from the group consisting of a methine compound represented by formula (1) in which A1 to A3 each represent a trimethinestreptocyanine dye, L1 to L4 each represent an alkylene group, and n1 represents an integer of not less than 0; a methine compound represented by formula (1) in which A1 to A3 each represent a pentamethinestreptocyanine dye, L1 to L4 each represent an alkylene group, and nl is 0 or 1; a methine compound represented by formula (1) in which A1 to A3 each represent a pentamethinestreptocyanine dye, L1 to L4 each represent an alkylene group, and n1 is an integer of not less than 2; and a methine compound represented by formula (1) in which A1 to A3 each represent a heptamethinestreptocyanine dye, L1 to L4 each represent an alkylene group, and n1 is an integer of not less than 0.

5. The silver halide light-sensitive material as claimed in claim 1, wherein the amount of the methine compound to be added is in the range of $4\times10^{-6}$ to $8\times10^{-3}$ mol, per mol of silver halide.

6. A silver halide light-sensitive material, comprising a light-sensitive silver halide emulsion layer containing a methine compound represented by formula (2):

formula (2)

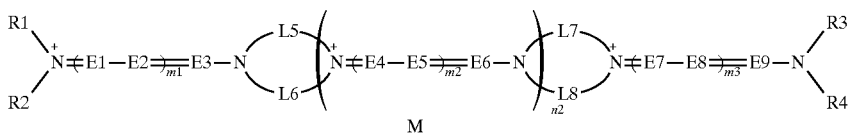

M wherein R1, R2, R3 and R4 each represent an alkyl group or an aryl group; E1, E2, E3, E4, E5, E6, E7, E8, and E9 each represent a methine group; L5, L6, L7, and L8 each represent a divalent linking group; ml, m2, m3, and n2 each represent an integer of not less than 0, and M represents an ion for change neutralization.

7. The silver halide light-sensitive material as claimed in claim 6, wherein L5, L6, L7, and L8 each represent an alkylene group, an alkenylene group, or an alkinylene group.

8. The silver halide light-sensitive material as claimed in claim 6, wherein n2 represents an integer of not more than 1,000.

9. The silver halide light-sensitive material as claimed in claim 6, wherein R1, R2, R3, and R4 each represent an alkyl group; L5, L6, L7, and L8 each represent an alkylene group; E1, E2, E3, E4, E5, E6, E7, E8, and E9 each represent an unsubstituted methine group; m1, m2, and m3 each represent 1, 2, or 3; and n2 is an integer of from 0 to 10.

10. The silver halide light-sensitive material as claimed in claim 6, wherein the amount of the methine compound to be added is in the range of $4\times10^{-6}$ to $8\times10^{-3}$ mol, per mol of silver halide.

* * * * *